US011788036B2

(12) United States Patent
Bonta

(10) Patent No.: US 11,788,036 B2
(45) Date of Patent: Oct. 17, 2023

(54) COMPOSITION FOR USE IN CLEANING METAL COMPONENTS

(71) Applicant: VGP IPCO LLC, Lexington, KY (US)

(72) Inventor: Jacob Bonta, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 212 days.

(21) Appl. No.: 17/404,704

(22) Filed: Aug. 17, 2021

(65) Prior Publication Data

US 2021/0371778 A1 Dec. 2, 2021

Related U.S. Application Data

(63) Continuation of application No. 16/552,022, filed on Aug. 27, 2019, now Pat. No. 11,124,745.

(51) Int. Cl.
*C11D 7/50* (2006.01)
*C11D 11/00* (2006.01)

(52) U.S. Cl.
CPC ..... *C11D 11/0029* (2013.01); *C11D 7/5018* (2013.01); *C11D 7/5022* (2013.01)

(58) Field of Classification Search
CPC ..... C11D 7/5022
USPC ..... 510/365
See application file for complete search history.

(56) References Cited

U.S. PATENT DOCUMENTS 5,612,303 A 3/1997 Takayanagi et al.
6,048,471 A 4/2000 Henry
6,306,943 B1 10/2001 Henry
6,429,176 B1 8/2002 Chen et al.
8,822,397 B1 9/2014 Yu et al.
2008/0287331 A1 11/2008 Lin et al.
2010/0240573 A1* 9/2010 Zysman ..... C11D 7/262 510/365

(Continued)

FOREIGN PATENT DOCUMENTS

WO 2017214042 A1 12/2017

OTHER PUBLICATIONS

Extended European Search Report dated Apr. 4, 2023 for European Application No. 19943565.2, 9 pages.

(Continued)

*Primary Examiner* — Gregory E Webb
(74) *Attorney, Agent, or Firm* — Benesch, Friedlander, Coplan & Aronoff LLP

(57) ABSTRACT

A composition for use in cleaning metal components having Hansen Solubility Parameters for the composition of $\delta_D \geq 15$, $\delta_P < 6$, and $\delta_H$ from about 5.5 to about 6.9. The composition includes a blend of organic solvents, none of which are classified as a volatile organic compound, a hazardous air pollutant, or a potential carcinogen, or exhibit a vapor pressure of less than 0.1 mmHg at 20° C. Further, the blend of organic solvents includes a halogenated aromatic solvent having one or more halide groups and from 6 to 8 carbon atoms, an organic solvent having one or more ester functional group and from 3 to 9 carbon atoms, and one or more of a linear or branched hydrocarbon solvent with 6-12 carbon atoms with a single polar moiety head group or a solvent containing one or more ketone functional groups and from 2 to 5 carbon atoms.

20 Claims, 1 Drawing Sheet

(56) References Cited

U.S. PATENT DOCUMENTS

| | | | | |
|---|---|---|---|---|
| 2012/0175562 | A1 | 7/2012 | Howard et al. | |
| 2014/0065432 | A1* | 3/2014 | Wuerch | C09J 11/06 428/447 |
| 2014/0311384 | A1 | 10/2014 | Ledford | |
| 2015/0126427 | A1 | 5/2015 | Holcombe, Jr. | |

OTHER PUBLICATIONS

Examination Report issued in Indian patent application No. 202217005744, dated Apr. 25, 2022.
Non-Final Office Action issued in U.S. Appl. No. 16/552,022, dated Feb. 12, 2021.

* cited by examiner

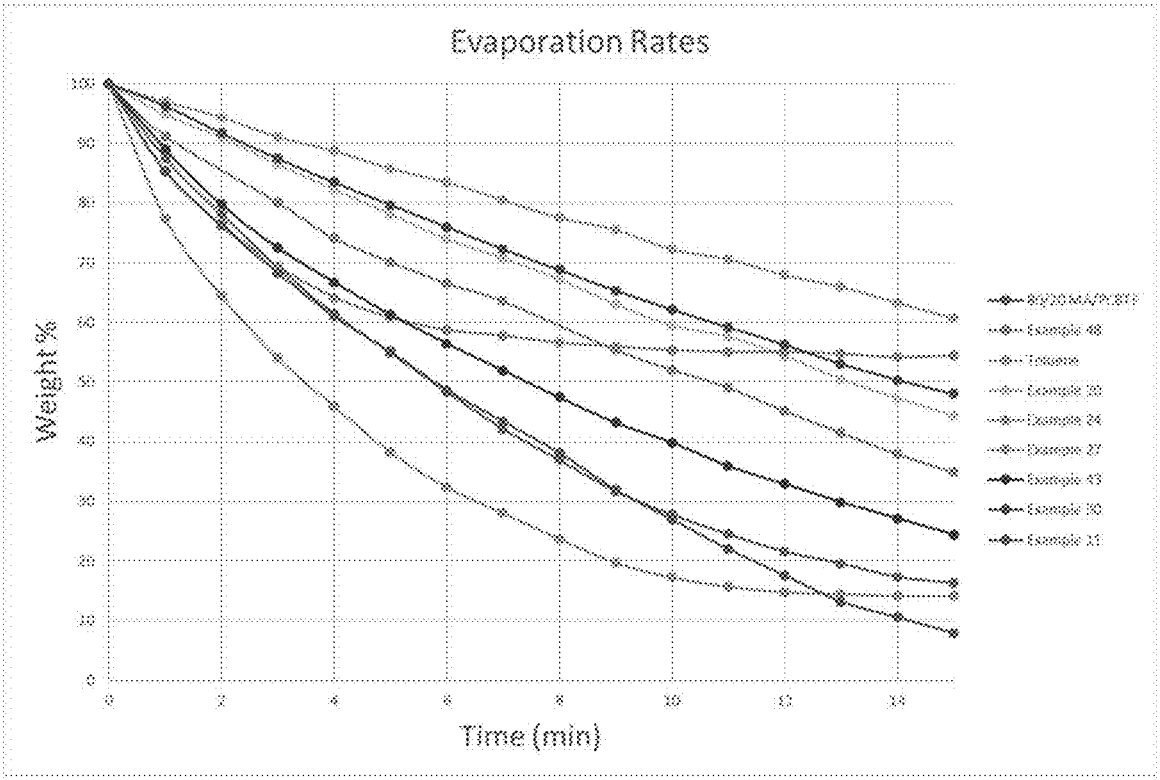
Evaporation Rates
Weight %
Time (min)
Toluene
Example 48
Example 30
Example 11

COMPOSITION FOR USE IN CLEANING METAL COMPONENTS

CROSS REFERENCE TO RELATED APPLICATIONS

This application is a continuation application and claims priority to U.S. application Ser. No. 16/552,022, titled "Composition for Use in Cleaning Metal Components" filed on Aug. 27, 2019. The entire disclosure of the above application in incorporated herein by reference.

FIELD

This disclosure is directed to a solvent composition for use in cleaning metal components. More specifically, the composition includes a blend of organic solvents that, while being exempted from, or not classified as, a volatile organic compound, a hazardous air pollutant, or a potential carcinogen.

BACKGROUND

Metal parts cleaners generally fall in to one of two categories: chlorinated solvents and hydrocarbon solvents. Although chlorinated solvents are non-flammable and are not classified as a volatile organic compound (VOC), they are generally considered to be a potential carcinogen and pose an less than acceptable health risk to users. Hydrocarbon solvents, on the other hand, possess favorable cleaning action and fast evaporation without residue, however, they have varying serious health risks, including potential carcinogenic effects. These solvents, such as toluene, benzene, xylene, and hexane, are classified as a VOC or a hazardous air pollutant (HAP), which limits their use in commercial settings. It would be beneficial to create a metal parts cleaner that has the solubility and cleaning action properties of these traditional solvents, but without the associated health risks to the user.

SUMMARY

A composition for use in cleaning metal components is disclosed. In one embodiment, the Hansen Solubility Parameters for the composition are δD≥15, δP<6, and δH from about 5.5 to about 6.9. Moreover, the composition includes a blend of organic solvents. In one embodiment, none of the organic solvents are classified as a volatile organic compound, a hazardous air pollutant, or a potential carcinogen, or wherein the solvent exhibits a vapor pressure of less than 0.1 mmHg at 20° C.

Specifically, the blend of organic solvents may include a halogenated aromatic solvent having one or more halide groups and from 6 to 8 carbon atoms, wherein the Hansen Solubility Parameters for the halogenated aromatic solvent are in the range of about δD: 17-19, δP: 5-7, and δH: 3-5; an organic solvent having one or more ester functional group and from 3 to 9 carbon atoms, wherein the Hansen Solubility Parameters for the organic solvent are in the range of about δD: 14-16, δP: 3.5-7.5, and δH: 5-10; and one or more of the following: a linear or branched hydrocarbon solvent with 6-12 carbon atoms with a single polar moiety head group, wherein the Hansen Solubility Parameters for the hydrocarbon solvent are in the range of about δD: 6-9, δP: 1-3, and δH: 5-7; and a solvent containing one or more ketone functional groups and from 2 to 5 carbon atoms, wherein the Hansen Solubility Parameters for the solvent containing one or more ketone functional groups are in the range of about δD: 14-16, δP: 8.5-11, and δH: 5-8.

In one embodiment, the halogenated aromatic solvent is parachlorobenzotriflouride which is present in an amount from about 0.25% to about 20% of the composition.

In another embodiment, the organic solvent with one or more ester functional groups is selected from the group consisting of tert-butyl acetate, methyl acetate, dimethyl carbonate, diethylene glycol monoethyl acetate, and diethylene glycol monobutyl ether acetate. In yet another embodiment, the organic solvent with one or more ester functional groups is tert-butyl acetate which is present in an amount from about 25% to about 65% of the composition.

In another embodiment, the hydrocarbon solvent having a single polar moiety head group is 1-butoxyhexanol or 2-ethyl-hexanol which is present in an amount from about 0.1% to about 1% of the composition.

In another embodiment, the solvent containing one or more ketone functional groups is acetone which is present in an amount from about 5% to about 50% of the composition.

BRIEF DESCRIPTION OF THE DRAWINGS

The accompanying FIGURES, which are incorporated in and constitute a part of the specification, illustrate various example configurations and data, and are used merely to illustrate various example embodiments. In the FIGURES, like elements bear like reference numerals.

FIG. 1 is the graphical representation of evaporation curves for various example formulations.

DETAILED DESCRIPTION

A composition for use in cleaning metal parts is provided. Specifically the composition includes a blend of organic solvents. In one embodiment, the blend includes one or more organic solvent, each of which are either 1) not classified as, or are exempt from being classified as, a VOC, a HAP, or a potential carcinogen or 2) have a vapor pressure of less than 0.1 mmHg at 20° C. Surprisingly, it has been found that this blend of organic solvents exhibits a cleaning action, solubility parameters, and evaporation rates (leading to decreased residue on the component) that are comparable to solvents considered to pose potential health risks.

Although none of the components of the blended composition are classified (or are exempt from being classified) as a VOC, HAP, or potential carcinogen, the resulting composition exhibits Hansen Solubility Parameters that are similar to those substances. Specifically, the Hansen Solubility Parameters for the blended composition have been found to be $\delta_D$≥14-16, $\delta_P$<3.5-7, and $\delta_H$ from about 5.5 to about 6.9.

In one embodiment, the composition is created by combining a halogenated aromatic solvent having one or more halide groups and from 6 to 8 carbon atoms, an organic solvent having one or more ester functional groups and from 3 to 9 carbon atoms, and one or more of a linear or branched hydrocarbon solvent with 6-12 carbon atoms with a single polar moiety head group and a solvent containing one or more ketone functional groups and from 2 to 5 carbon atoms.

In one embodiment, the halogenated aromatic solvent having one or more halide groups and from 6 to 8 carbon atoms has Hansen Solubility Parameters that are in the range of about δD: 17-19, δP: 5-7, and δH: 3-5 and is present in the composition in an amount of from 0.25% to 20%, and preferably from about 1% to about 9%, of the total composition. Further, it should be understood that these halogenated aromatic solvents are not considered a HAP or potential carcinogen and are exempted from VOC, or they exhibit a vapor pressure of less than about 0.1 mmHg at 20° C. In one embodiment, the halogenated aromatic solvent is parachlorobenzotriflouride (PCBTF).

In another embodiment, the organic solvent having one or more ester functional group and from 3 to 9 carbon atoms has Hansen Solubility Parameters that are in the range of about δD: 14-16, δP: 3.5-7.5, and δH: 5-10 and is present in the composition in an amount from about 25% to about 65% of the total composition. Further, it should be understood that these ester-containing organic solvents are not considered a HAP or potential carcinogen and are exempted from VOC, or they exhibit a vapor pressure of less than about 0.1 mmHg at 20° C. In one embodiment the ester-containing organic solvent may be methyl acetate, dimethyl carbonate, diethylene glycol monoethyl ether/diethylene glycol monobutyl ether acetate (commercially available from Eastman Chemical Company), t-butyl acetate. In another embodiment, the solvent is t-butyl acetate.

In another embodiment the linear or branched hydrocarbon solvent with 6-12 carbon atoms and a single polar moiety head group has Hansen Solubility Parameters that are in the range of about δD: 6-9, δP: 1-3, and δH: 5-7 and when present in the composition, is present in the amount of about 0.1 to about 1.2%, and in another embodiment from about 0.1 to about 1.0%. Further, it should be understood that these linear or branched hydrocarbon solvents are not considered a HAP or potential carcinogen and are exempted from VOC, or they exhibit a vapor pressure of less than about 0.1 mmHg at 20° C. In one embodiment, the hydrocarbon solvent is 2-butoxyhexanol or 2-ethylhexanol. In another embodiment, the hydrocarbon solvent is 2-ethylhexanol.

These medium chain length organic solvents may function as a surfactant, lowering the surface tension between the product and the soiled surfaces. Moreover, the organic solvents have been found to enhance the composition's wetting action, and thus, its cleaning ability without leaving a residue or adversely affecting the drying rate.

In another embodiment, the solvent containing one or more ketone functional groups and from 2 to 5 carbon atoms has Hansen Solubility Parameters that are in the range of about δD: 14-16, δP: 8.5-11, and δH: 5-8 and when present in the composition, is present in an amount of about 5% to about 50%. Further, it should be understood that these solvents are not considered a HAP or potential carcinogen and are exempted from VOC, or they exhibit a vapor pressure of less than about 0.1 mmHg at 20° C. In one embodiment, the solvent containing one or more ketone functional group is acetone. It has been found that the addition of a solvent, such as acetone, enhances the evaporation rate of the blended composition.

EXAMPLES

Solvent Effect—Varied Soils

Individual solvents were evaluated by visual inspection of solvation action when applied to various soils encountered in automotive cleaning procedures. The soils used for testing included 10W-30 motor oil, DOT 3 brake fluid, #2 Lithium Grease, and Power Steering Fluid. Solvation was evaluated on a relative scale: Poor, Fair, Good and Excellent. The rating is based on the solvent's ability to blend with the soil of interest, the rate of the blending, the amount of solvent required to remove the soil from the substrate and the amount of residue left behind by the solvent.

Test Procedure

In one example, the individual solvents were evaluated. Aluminum test dishes were prepared by applying approximately 5 drops of each soil to the dishes. Neat solvent was added dropwise beside each soil so that the edges of the two materials came in contact with one another. The solvation action of the solvent was observed. The extent to which the soil and the solvent mixed and the rate of mixing was observed. Additional solvent was then applied to each section and the dish was lifted to observe the removal of the soil. Another addition of solvent was applied by pipette (approx. 1-2 mL) to observe the spray-off characteristics of each soil/solvent combination.

TABLE 1

Relative Solvation Rating Standards

| Rating | Explanation |
|---|---|
| Poor | Little or no solvation. Very slow rate of solvation. Large amount of soil residue after spray. |
| Fair | Some, slow solvation effect. Slow to Moderate solvation rate. Moderate amount of soil residue after spray. |
| Good | Significant solvation effect. Moderate to rapid solvation rate. Small amount of residue after spray. |
| Excellent | Significant solvation effect. Rapid/extensive solvation rate. No soil residue after spray. |

The results of the Hansen Solubility calculations and evaporation rate data are shown below in Table 2:

TABLE 2

| | | Hansen Data | | | | Evaporation Rate |
|---|---|---|---|---|---|---|
| Solvents | VOC | dD | dP | dH | MVol | (BuAc = 1) |
| Toluene | Yes | 18 | 1.4 | 2 | 106.6 | 1.9 |
| Xylene | Yes | 17.6 | 1 | 3.1 | 123.9 | 0.6 |
| Heptane | Yes | 15.3 | 0 | 0 | 147 | 4.3 |
| Eastman EEH | No | 7.8 | 2 | 2.5 | 195.9 | 0.003 |
| 2-ethyl hexanol | No | 7.8 | 1.6 | 5.8 | 123.9 | <0.01 |
| dibasic ester LVP | No | 8.3 | 2.2 | 0 | 151.21 | 0.009 |
| Dowanol Eph | No | 17.8 | 5.7 | 14.3 | 124.5 | 0.001 |
| Eastman Omnia | No | 7.87 | 3.13 | 5.62 | 164.99 | 0.01 |
| Eastman DE Acetate | No | 7.9 | 2.5 | 4.5 | 174.12 | 0.008 |
| Eastman DB Acetate | No | 7.8 | 3.4 | 5.2 | 208.44 | 0.003 |
| Eastman DP Solvent | No | 7.8 | 3.5 | 5.5 | 152.78 | 0.01 |
| Eastman Texanol | No | 7.8 | 3.5 | 5.5 | 152.78 | 0.002 |
| Acetone | No | 15.5 | 10.4 | 7 | 73.8 | 14.4 |
| PCBTF | No | 18 | 5.9 | 3.9 | 134.75 | 0.9 |
| t-butyl acetate | No | 15 | 3.7 | 6 | 132.6 | 2.8 |
| dimethyl carbonate | No | 8.5 | 4.7 | 1.9 | 84.2 | 3.22 |
| Carbitol Solvent | No | 16.1 | 9.2 | 12.2 | 135.56 | 0.01 |
| Methyl Acetate | No | 15.5 | 7.2 | 7.6 | 79.8 | 6 |
| Propylene Carbonate | No | 20 | 18 | 4.1 | 85.2 | 0.005 |

The results of the Solvent Effect data for various soils are shown below in Table 3:

TABLE 3

| | | Solvent Effect-Varied Soils | | | |
|---|---|---|---|---|---|
| Solvents | VOC | Motor Oil | Brake Fluid | Power Steering Fluid | Greases |
| Toluene | Yes | Excellent | Good | Good | Good |
| Xylene | Yes | Excellent | Good | Good | Good |

TABLE 3-continued

| Solvents | VOC | Solvent Effect-Varied Soils | | | |
|---|---|---|---|---|---|
| | | Motor Oil | Brake Fluid | Power Steering Fluid | Greases |
| Heptane | Yes | Excellent | Good | Good | Good |
| Eastman EEH | No | Good | Good | Fair | Fair |
| 2-ethyl hexanol | No | Good | Fair | Poor | Excellent |
| dibasic ester LVP | No | Poor/Fair | Poor | Poor/Fair | Good |
| Dowanol Eph | No | Good | Excellent | Good | Fair |
| Eastman Omnia | No | Good | Good | Good | Poor/Fair |
| Eastman DE Acetate | No | Fair/Good | Good | Fair/Good | Poor |
| Eastman DB Acetate | No | Fair/Good | Good | Fair/Good | Poor |
| Eastman DP Solvent | No | Fair/Good | Good | Fair/Good | Poor |
| Eastman Texanol | No | Good | Fair/Good | Good | Poor |
| Acetone | No | Poor | Good | Excellent | Poor |
| PCBTF | No | Excellent | Excellent | Fair | Fair |
| t-butyl acetate | No | Excellent | Excellent | Fair | Fair |
| dimethyl carbonate | No | Poor | Good | Good | Poor |
| Carbitol Solvent | No | Fair/Good | Good | Good | Poor |
| Methyl Acetate | No | Fair/Good | Excellent | Good | Poor |
| Propylene Carbonate | No | Fair | Fair/Good | Good | Poor |

Solvation in this context can be readily characterized by example. "No solvation" can be described by two materials that will not blend in any proportions, i.e. oil and water. For example, if a drop of oil and a drop of water are placed beside each other with edges touching they will not blend and thus have no solvation. The opposite, and thus "excellent solvation," would be two materials that are miscible and will blend in any proportion. One example would be water and ethanol. If a drop of each were placed beside one another, with edges touching, the two would rapidly blend together and form a homogenous phase. Most materials have some degree of solubility with each other. The relative scale used above describes this, but also includes an observation of the rate at which it occurs. Excellent is near instantaneous. Good occurs over 1-3 seconds. Fair is over 5-20 seconds and poor requires significant time to solvate 30 seconds to several minutes. Similar quantification methods were used for the solvent blend tests, described below.

Solvent Blend Effects—Application Testing on Varied Soils

In one example, the solvent blends were evaluated by visual inspection of their solvation action when applied to various soils encountered in automotive cleaning procedures. The soils used for testing were 10W-30 motor oil, DOT 3 brake fluid, #2 Lithium Grease, and Power Steering Fluid. Solvation was evaluated on a relative scale: Poor, Fair, Good and Excellent. The rating is based on the solvent blends ability to remove various soils from test panels. The effect is bracketed by the performance of the 10% VOC Parts cleaner on the low end and by the 45% VOC Parts Cleaner on the upper end and characterizes the solvent blend's ability to blend with the soil of interest, the rate of the blending, the amount of solvent blend required to remove the soil from the substrate, and the amount of residue left behind by the solvent.

Test Procedure

Steel test panels were prepared by the following method. A thin film of NLGI #2 lithium complex grease, polyurea grease, and calcium sulfonate grease were applied to the steel test panels in sections with a rag. Approximately 3-5 mL of 10w-30 conventional motor oil, DOT 3 brake fluid, and power steering fluid were then applied in small puddles and smeared with a rag or paper towel. The panels were then baked at 60° C. for approximately 16 hours to simulate service conditions.

Once the panels were prepared, the individual solvent blends were prepared by mixing together the individual components in a glass beaker and then stirring the blends for 1-2 minutes. About 200 g of the blends were then charged into standard 12 oz aerosol cans. The cans were then pressurized to approximately 100 PSI with $CO_2$, shaken well, and allowed to sit at least two hours to ensure $CO_2$ dissolution.

The individual solvent blends were then tested by the following method. Performance of test blends were compared to the Valvoline Professional Series (VPS) 10% VOC Parts Cleaner (commercially available from Valvoline LLC), for a low performance mark, and the VPS 45% VOC Parts Cleaner (commercially available from Valvoline LLC), for a high-performance mark. In a well-ventilated area or fume hood, the prepared panels were positioned above a catch pan. The test blends were then sprayed onto the soils in 2-3 second bursts, targeting each soil type individually. Each test blend was allowed to penetrate the soils for approximately 5-10 seconds. The test blends were then sprayed onto the soils again, targeting each soil type individually for an additional 2-3 second burst.

The cleaning performance was inspected visually between the first and second burst and after the panel was allowed to dry. They were evaluated by the same relative rating standards as above.

The compositions of the sample solvent blends are set forth in Table 4 below:

TABLE 4

| Sample # | Acetone | t-butyl acetate | PCBTF | 2-ethylhexanol | Eastman EEH |
|---|---|---|---|---|---|
| 1 | 50 | 25 | 25 | 0 | 0 |
| 2 | 75 | 12.5 | 12.5 | 0 | 0 |
| 3 | 90 | 5 | 5 | 0 | 0 |
| 4 | 50 | 50 | 0 | 0 | 0 |
| 5 | 75 | 25 | 0 | 0 | 0 |
| 6 | 90 | 10 | 0 | 0 | 0 |
| 7 | 50 | 0 | 50 | 0 | 0 |
| 8 | 75 | 0 | 25 | 0 | 0 |
| 9 | 90 | 0 | 10 | 0 | 0 |
| 10 | 80 | 10 | 10 | 0 | 0 |
| 11 | 80 | 15 | 5 | 0 | 0 |
| 12 | 80 | 5 | 15 | 0 | 0 |
| 13 | 75 | 15 | 10 | 0 | 0 |
| 14 | 75 | 20 | 5 | 0 | 0 |
| 15 | 75 | 10 | 15 | 0 | 0 |
| 16 | 65 | 35 | 0 | 0 | 0 |
| 17 | 65 | 25 | 10 | 0 | 0 |
| 18 | 65 | 30 | 5 | 0 | 0 |
| 19 | 50 | 40 | 10 | 0 | 0 |
| 20 | 50 | 45 | 5 | 0 | 0 |
| 21 | 25 | 65 | 10 | 0 | 0 |
| 22 | 0 | 85 | 15 | 0 | 0 |
| 23 | 65 | 32.5 | 2.5 | 0 | 0 |
| 24 | 50 | 0 | 0 | 50 | 0 |
| 25 | 75 | 0 | 0 | 25 | 0 |
| 26 | 65 | 0 | 0 | 35 | 0 |
| 27 | 90 | 0 | 0 | 10 | 0 |
| 28 | 0 | 50 | 0 | 50 | 0 |
| 29 | 0 | 65 | 0 | 35 | 0 |
| 30 | 0 | 75 | 0 | 25 | 0 |
| 31 | 0 | 90 | 0 | 10 | 0 |
| 32 | 65 | 0 | 0 | 0 | 35 |
| 33 | 75 | 0 | 0 | 0 | 25 |
| 34 | 90 | 0 | 0 | 0 | 10 |
| 35 | 0 | 65 | 0 | 0 | 35 |
| 36 | 0 | 75 | 0 | 0 | 25 |
| 37 | 0 | 90 | 0 | 0 | 10 |
| 38 | 50 | 45 | 2.5 | 2.5 | 0 |
| 39 | 50 | 45 | 4 | 1 | 0 |
| 40 | 50 | 40 | 9 | 1 | 0 |
| 41 | 50 | 40 | 0 | 10 | 0 |

TABLE 4-continued

| Sample # | Acetone | t-butyl acetate | PCBTF | 2-ethylhexanol | Eastman EEH |
|---|---|---|---|---|---|
| 42 | 50 | 45 | 0 | 5 | 0 |
| 43 | 50 | 40 | 5 | 5 | 0 |
| 44 | 0 | 90 | 5 | 5 | 0 |
| 45 | 0 | 90 | 9 | 1 | 0 |
| 46 | 29 | 65 | 5 | 1 | 0 |
| 47 | 0 | 95 | 4 | 1 | 0 |
| 48 | 29 | 67.5 | 2.5 | 1 | 0 |
| 49 | 0 | 96.5 | 2.5 | 1 | 0 |

The Hansen Solubility Parameters were calculated for each sample. The data from those calculations are provided below in Table 5.

TABLE 5

| | Hansen Solubility Parameters | | |
|---|---|---|---|
| Sample # | dD | dP | dH |
| 1 | 13.8 | 6.9 | 5.5 |
| 2 | 15.8 | 9.0 | 6.5 |
| 3 | 15.6 | 9.84 | 6.795 |
| 4 | 15.25 | 7.05 | 6.5 |
| 5 | 15.375 | 8.725 | 6.75 |
| 6 | 15.45 | 9.73 | 6.9 |
| 7 | 16.75 | 8.15 | 5.45 |
| 8 | 16.125 | 9.275 | 6.225 |
| 9 | 15.75 | 9.95 | 6.69 |
| 10 | 15.7 | 9.28 | 6.59 |
| 11 | 15.55 | 9.17 | 6.695 |
| 12 | 15.85 | 9.39 | 6.485 |
| 13 | 15.675 | 8.945 | 6.54 |
| 14 | 15.525 | 8.835 | 6.645 |
| 15 | 15.825 | 9.055 | 6.435 |
| 16 | 15.325 | 8.055 | 6.65 |
| 17 | 15.625 | 8.275 | 6.44 |
| 18 | 15.475 | 8.165 | 6.545 |
| 19 | 15.55 | 7.27 | 6.29 |
| 20 | 15.4 | 7.16 | 6.395 |
| 21 | 15.425 | 5.595 | 6.04 |
| 22 | 15.45 | 4.03 | 5.685 |
| 23 | 15.4 | 8.11 | 6.5975 |
| 24 | 11.65 | 6 | 6.4 |
| 25 | 13.575 | 8.2 | 6.7 |
| 26 | 12.805 | 7.32 | 6.58 |
| 27 | 14.73 | 9.52 | 6.88 |
| 28 | 11.4 | 2.65 | 5.9 |
| 29 | 12.48 | 2.965 | 5.93 |
| 30 | 13.2 | 3.175 | 5.95 |
| 31 | 14.28 | 3.49 | 5.98 |
| 32 | 12.805 | 7.46 | 5.425 |
| 33 | 13.575 | 8.3 | 5.875 |
| 34 | 14.73 | 9.56 | 6.55 |
| 35 | 12.48 | 3.105 | 4.775 |
| 36 | 13.2 | 3.275 | 5.125 |
| 37 | 14.28 | 3.53 | 5.65 |
| 38 | 15.145 | 7.0525 | 6.4425 |
| 39 | 15.298 | 7.117 | 6.414 |
| 40 | 15.448 | 7.227 | 6.309 |
| 41 | 14.53 | 6.84 | 6.48 |
| 42 | 14.89 | 6.945 | 6.49 |
| 43 | 15.04 | 7.055 | 6.385 |
| 44 | 14.79 | 3.705 | 5.885 |
| 45 | 15.198 | 3.877 | 5.809 |
| 46 | 15.223 | 5.732 | 6.183 |
| 47 | 15.048 | 3.767 | 5.914 |
| 48 | 15.148 | 5.677 | 6.2355 |
| 49 | 15.003 | 3.734 | 5.9455 |

The results of the solvent removal data are set forth in Table 6, below.

TABLE 6

| | Observations (based on a summary of all soils used) | | | |
|---|---|---|---|---|
| Sample # | Solvency | Soil Removal | Evaporation Rate | Residue |
| 1 | Fair | Fair | Fair (slow) | Significant |
| 2 | Fair | Poor | Fair | Extensive |
| 3 | Poor | Poor | Too fast | Extensive |
| 4 | Fair | Good | Fair | Significant |
| 5 | Fair | Fair | — | Significant |
| 6 | Poor | Poor | Too fast | Extensive |
| 7 | Good | Good | Too slow | Significant |
| 8 | Fair | Good | Too slow | Significant |
| 9 | Poor | Fair | Fair | Extensive |
| 10 | Fair | Fair | Fair | Extensive |
| 11 | Fair | Fair | Fair | Extensive |
| 12 | Fair | Fair | Too slow | Extensive |
| 13 | Fair | Good | Fair | Significant |
| 14 | Good | Good | Fair | Significant |
| 15 | Fair | Good | Too slow | Significant |
| 16 | Good | Fair | Fair | Minimal |
| 17 | Good | Good | Good | Minimal |
| 18 | Good | Good | Good | Minimal |
| 19 | Excellent | Good | Good | Minimal |
| 20 | Excellent | Good | Good | Minimal |
| 21 | Excellent | Good | Fair | None |
| 22 | Excellent | Good | Fair | None |
| 23 | Good | Fair | Good | Significant |
| 24 | Poor | Fair | Too slow | Extensive |
| 25 | Fair | Fair | Too slow | Extensive |
| 26 | Fair | Good | Too slow | Significant |
| 27 | Poor | Fair | Too slow | Extensive |
| 28 | Fair | Good | Too slow | None |
| 29 | Good | Good | Too slow | None |
| 30 | Good | Good | Too slow | None |
| 31 | Excellent | Excellent | Too slow | None |
| 32 | Fair | Good | Too slow | Significant |
| 33 | Fair | Good | Too slow | Significant |
| 34 | Poor | Poor | Fair | Significant |
| 35 | Good | Good | Too slow | None |
| 36 | Good | Good | Too slow | None |
| 37 | Excellent | Excellent | Fair | None |
| 38 | Good | Good | Fair | Minimal |
| 39 | Good | Good | Good | Minimal |
| 40 | Good | Good | Good | Minimal |
| 41 | Good | Excellent | Too slow | Significant |
| 42 | Good | Excellent | Too slow | Significant |
| 43 | Good | Excellent | Too slow | Significant |
| 44 | Excellent | Excellent | Poor | None |
| 45 | Excellent | Excellent | Good | None |
| 46 | Excellent | Excellent | Good | None |
| 47 | Excellent | Excellent | Fair | None |
| 48 | Excellent | Excellent | Excellent | None |
| 49 | Excellent | Excellent | Good | None |

It will be understood that if a composition has an evaporation rate that is deemed to be "too slow," the solvent composition can be observed to linger on the cleaning surface or area around it for a significant amount of time (approximately 5 to about 10 minutes). If an evaporation rate is too slow, one would have to clean the soiled surface by another means (rag/paper towel, etc.) before continuing work.

Conversely, if a composition has an evaporation rate that is considered to be "too fast," the solvent composition does not dwell long enough on the soiled surface to either solvate the soil completely or facilitate its transport from the surface being cleaned. This results in having to use more product to transport the soil from the surface of the component being cleaned and can result in significant residue as well.

As can be seen from the data above, blended compositions that include about 25 to 30% acetone, about 97 to 65% t-butyl acetate, about 2.5 to about 5% PCBTF, and about 1% 2-ethylhexanol produce high quality cleaning composition, without the expected health risks generally associated with known metal parts cleaners. In one embodiment, the blended composition will preferably include about 29% acetone, about 67.5% t-butyl acetate, about 2.5% PCBTF, and about 1% 2-ethylhexanol, as in Sample #48.

There seems to be a strong relation between soil removal efficiency and the evaporation rate of the composition, with slow evaporation rates favoring improved soil removal. Moreover, while large amounts of 2-ethylhexanol appeared to negatively impact the evaporation rate of the overall composition, small amounts, that is less than about 2.5% of the total weight percent of the blend, appear to improve the wetting action of the other solvents and helped to improve the soil removal action of the blended composition. While not being bound to theory, it is believed that the presence of a small amount of 2-ethylhexanol reduces the evaporation rate of the composition enough to allow for thorough penetration of persistent soils, thus reducing the amount of blended composition required to achieve acceptable soil removal.

To that end, the evaporation rates of examples formulations were compared. Approximately 3 grams of each sample were weighed onto a 3 inch watch glass and left exposed in a fume hood at a face velocity of 109 feet per minute (FPM). The weight change of each sample was recorded as a function of time over approximately 15-17. As shown in FIG. 1, this data was then plotted by weight change per minute. With continuing reference to FIG. 1, it was found that the methyl acetate and PCBTF formula, lost nearly 85% of its weight in only 16 minutes. Sample #48, however, performed much better, losing only about 67.7%, while the toluene composition lost only 41.5% weight. The optimized evaporation rate of Sample #48 allow the formulations to remain on the soil for longer periods of time, increasing the soil removal capability, while minimizing the residue left behind.

In addition, the data shows that small amounts of PCBTF, from about 2.0% to about 20%, appears to have a synergistic solvation effect with acetone and t-butyl acetate. It is likely that the presence of an aromatic moiety and a chlorinated/fluorinated functionality contributes to this effect.

Finally, the data shows that the ability to control the evaporation rate has a large impact on the blended composition's overall performance. Preferably, a "stepwise" evaporation curve, with components in increasingly small amounts, with increasingly slower evaporation rates allows for soil penetration, but prevents a significant amount of residual cleaner from remaining on the soiled component part. This will ultimately improve the performance of the blended composition and reduce the amount needed.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. A composition for use in cleaning metal components, the composition comprising:

a blend of organic solvents, wherein none of the solvents are classified as a volatile organic compound, and the blend of organic solvents comprises:

from about 1% to about 9% parachlorobenzotrifluoride;

from about 25% to about 70% tert-butyl acetate; and one or more of the following:

from about 0.1 to about 1% 2-ethylhexanol, and from about 5% to about 75% acetone.

2. The composition of claim 1, wherein the Hansen Solubility Parameters for the composition are $\delta_D \geq 15$, $\delta_P < 6$, and $\delta_H$ from about 5.5 to about 6.9.

3. The composition of claim 1, wherein the composition is free of acetone and the blend of organic solvents comprises:

about 90% tert-butyl acetate;

about 9% parachlorobenzotrifluoride; and about 1% 2-ethylhexanol.

4. The composition of claim 1, wherein the blend of organic solvents comprises:

about 29% acetone;

about 65% tert-butyl acetate;

about 5% parachlorobenzotrifluoride; and about 1% 2-ethylhexanol.

5. The composition of claim 1, wherein the composition is free of acetone and the blend of organic solvents comprises:

about 95% tert-butyl acetate;

about 4% parachlorobenzotrifluoride; and about 1% 2-ethylhexanol.

6. The composition of claim 1, wherein the blend of organic solvents comprises:

about 29% acetone;

about 67.5% tert-butyl acetate;

about 2.5% parachlorobenzotrifluoride; and about 1% 2-ethylhexanol.

7. The composition of claim 1, wherein the composition is free of acetone and the blend of organic solvents comprises:

about 96.5% tert-butyl acetate;

about 2.5% parachlorobenzotrifluoride; and about 1% 2-ethylhexanol.

8. A composition for use in cleaning metal components, wherein the composition comprises a blend of organic solvents and none of the solvents are classified as a volatile organic compound;

the composition is configured to have an evaporation rate to allow the composition to remain on the metal components for cleaning and minimizing residues left behind; and the Hansen Solubility Parameters for the composition are $\delta_D \geq 15$, $\delta_P < 6$, and $\delta_H$ from about 5.5 to about 6.9.

9. The composition of claim 8, wherein the composition is configured to lose about 67.7% weight in about sixteen minutes after being applied to the metal components.

10. The composition of claim 9, wherein the blend of organic solvents comprises:

about 29% acetone;

about 67.5% tert-butyl acetate;

about 2.5% parachlorobenzotrifluoride; and about 1% 2-ethylhexanol.

11. The composition of claim 9, wherein the Hansen Solubility Parameters for the composition are $\delta_D$ about 15.148, $\delta_P$ about 5.677, and $\delta_H$ about 6.2355.

12. A method of cleaning metal components, comprising:

charging a composition into an aerosol can, wherein the composition comprises a blend of organic solvents, none of the solvents are classified as a volatile organic compound, and the blend of organic solvents comprises:

from about 1% to about 9% parachlorobenzotrifluoride;

from about 25% to about 70% tert-butyl acetate; and one or more of the following:

from about 0.1 to about 1% 2-ethylhexanol, and from about 5% to about 75% acetone;

pressurizing the aerosol can; and spraying the composition onto the metal components.

13. The method of claim 12, wherein the Hansen Solubility Parameters for the composition are $\delta_D \geq 15$, $\delta_P < 6$, and $\delta_H$ from about 5.5 to about 6.9.

14. The method of claim 12, wherein the composition is free of acetone and the blend of organic solvents comprises:

about 90% tert-butyl acetate about 9% parachlorobenzotrifluoride; and about 1% 2-ethylhexanol.

15. The method of claim 12, wherein the blend of organic solvents comprises:

about 29% acetone;

about 65% tert-butyl acetate;

about 5% parachlorobenzotrifluoride; and about 1% 2-ethylhexanol.

16. The method of claim 12, wherein the composition is free of acetone and the blend of organic solvents comprises:

about 95% tert-butyl acetate;

about 4% parachlorobenzotrifluoride; and about 1% 2-ethylhexanol.

17. The method of claim 12, wherein the blend of organic solvents comprises:

about 29% acetone;

about 67.5% tert-butyl acetate;

about 2.5% parachlorobenzotrifluoride; and about 1% 2-ethylhexanol.

18. The method of claim 12, wherein the composition is free of acetone and the blend of organic solvents comprises:

about 96.5% tert-butyl acetate;

about 2.5% parachlorobenzotrifluoride; and about 1% 2-ethylhexanol.

19. The method of claim 12, wherein the composition has an evaporation rate to allow the composition to remain on the metal components for cleaning and minimizing residues left behind.

20. The method of claim 19, wherein the composition is configured to lose about 67.7% weight in about sixteen minutes after being applied to the metal components.

* * * * *